US010395822B2

(12) United States Patent
Miwa et al.

(10) Patent No.: US 10,395,822 B2
(45) Date of Patent: Aug. 27, 2019

(54) RARE-EARTH MAGNET, METHOD OF MANUFACTURING RARE-EARTH MAGNET, AND ROTATOR

(75) Inventors: Masashi Miwa, Tokyo (JP); Yasuyuki Kawanaka, Tokyo (JP); Masahiro Oishi, Tokyo (JP)

(73) Assignee: TDK CORPORATION, Tokyo (JP)

( * ) Notice: Subject to any disclaimer, the term of this patent is extended or adjusted under 35 U.S.C. 154(b) by 506 days.

(21) Appl. No.: 13/052,424

(22) Filed: Mar. 21, 2011

(65) Prior Publication Data

US 2011/0234348 A1 Sep. 29, 2011

(30) Foreign Application Priority Data

Mar. 23, 2010 (JP) ..... 2010-066725
Sep. 28, 2010 (JP) ..... 2010-217154

(51) Int. Cl.
*H01F 41/02* (2006.01)
*H01F 10/12* (2006.01)
(Continued)

(52) U.S. Cl.
CPC ..... *H01F 41/026* (2013.01); *C22C 38/002* (2013.01); *C22C 38/005* (2013.01);
(Continued)

(58) Field of Classification Search
CPC ..... B22F 2998/10; B22F 2003/242; B22F 2003/244; B22F 2003/248; B22F 3/087; B22F 3/10; B22F 9/04; B22F 2207/01; C22C 38/002; C22C 38/005; C22C 38/06; C22C 38/10; C22C 38/16; C23C 10/20;
(Continued)

(56) References Cited

U.S. PATENT DOCUMENTS 7,377,985 B2 5/2008 Zhang et al.
7,985,303 B2 7/2011 Nagata et al.
(Continued)

FOREIGN PATENT DOCUMENTS

CN 1570155 A 1/2005
CN 101006534 A 7/2007
(Continued)

OTHER PUBLICATIONS

European Search Report issued in Application No. 11159094.9 dated Jul. 1, 2011.

*Primary Examiner* — Holly C Rickman
*Assistant Examiner* — Lisa Chau
(74) *Attorney, Agent, or Firm* — Oliff PLC

(57) ABSTRACT

A rare-earth magnet is an R-T-B-based rare-earth magnet containing a rare-earth element R, a transition metal element T, and boron B. The rare-earth magnet further contains Cu and Co, while having a Cu concentration distribution with a gradient along a direction from a surface of the rare-earth magnet to the inside thereof, Cu having a higher concentration on the surface side of the rare-earth magnet than on the inside thereof, and a Co concentration distribution with a gradient along a direction from the surface of the rare-earth magnet to the inside thereof, Co having a higher concentration on the surface side of the rare-earth magnet than on the inside thereof. The rare-earth magnet is excellent in corrosion resistance.

8 Claims, 9 Drawing Sheets

(51) Int. Cl.

| | |
|---|---|
| ***C22C 38/00*** | (2006.01) |
| ***C22C 38/06*** | (2006.01) |
| ***C22C 38/10*** | (2006.01) |
| ***C22C 38/16*** | (2006.01) |
| ***C23C 10/20*** | (2006.01) |
| ***H01F 1/057*** | (2006.01) |

(52) U.S. Cl.
CPC ..... *C22C 38/06* (2013.01); *C22C 38/10* (2013.01); *C22C 38/16* (2013.01); *C23C 10/20* (2013.01); *H01F 10/126* (2013.01); *B22F 2207/01* (2013.01); *B22F 2998/10* (2013.01); *H01F 1/0577* (2013.01); *H01F 41/0293* (2013.01)

(58) Field of Classification Search
CPC ... H01F 1/0577; H01F 41/026; H01F 41/0293
See application file for complete search history.

(56) References Cited

U.S. PATENT DOCUMENTS

| | | | | |
|---|---|---|---|---|
| 8,025,744 | B2 | 9/2011 | Nagata et al. | |
| 8,252,123 | B2 | 8/2012 | Nagata et al. | |
| 8,277,578 | B2 | 10/2012 | Nagata et al. | |
| 2002/0004141 | A1 | 1/2002 | Schrey et al. | |
| 2006/0292395 | A1* | 12/2006 | Mori et al. | 428/692.1 |
| 2007/0240789 | A1* | 10/2007 | Nakamura | H01F 41/0293 148/101 |
| 2009/0020193 | A1* | 1/2009 | Ohta | H01F 1/0577 148/559 |
| 2009/0087672 | A1* | 4/2009 | Miwa et al. | 428/469 |
| 2009/0224615 | A1* | 9/2009 | Komuro | H01F 41/0293 310/46 |
| 2009/0322459 | A1 | 12/2009 | Nagata et al. | |
| 2010/0007232 | A1 | 1/2010 | Komuro et al. | |
| 2010/0233016 | A1* | 9/2010 | Tsubokura et al. | 420/83 |
| 2011/0036458 | A1 | 2/2011 | Nagata et al. | |
| 2011/0090032 | A1 | 4/2011 | Nagata et al. | |

FOREIGN PATENT DOCUMENTS

| | | | | |
|---|---|---|---|---|
| EP | 1 845 539 | A2 | 10/2007 | |
| EP | 1 879 201 | A1 | 1/2008 | |
| JP | 62192566 | A * | 8/1987 | |
| JP | A-62-192566 | | 8/1987 | |
| JP | A-2001-196215 | | 7/2001 | |
| JP | A-2002-025812 | | 1/2002 | |
| JP | 2003031409 | A * | 1/2003 | H01F 1/0577 |
| JP | A-2003-031409 | | 1/2003 | |
| JP | A-2004-143595 | | 5/2004 | |
| JP | A-2005-286173 | | 10/2005 | |
| JP | A-2005-286174 | | 10/2005 | |
| JP | A-2005-286175 | | 10/2005 | |
| JP | A-2006-100434 | | 4/2006 | |
| JP | A-2006-210450 | | 8/2006 | |
| JP | A-2008-235343 | | 10/2008 | |
| JP | A-2010-034365 | | 2/2010 | |
| JP | A-2010-114200 | | 5/2010 | |
| WO | WO 2006/112403 | A1 | 10/2006 | |
| WO | WO 2009004994 | A1 * | 1/2009 | |

* cited by examiner (a)

(b)

(c)

RARE-EARTH MAGNET, METHOD OF MANUFACTURING RARE-EARTH MAGNET, AND ROTATOR

BACKGROUND OF THE INVENTION

Field of the Invention

The present invention relates to a rare-earth magnet, a method of manufacturing the rare-earth magnet, and a rotator.

Related Background Art

R—T—B-based rare-earth magnets containing a rare-earth element R, a transition metal element T such as iron (Fe) or cobalt (Co), and boron (B) have excellent magnetic characteristics (see Japanese Patent Application Laid-Open No. 2001-196215, Japanese Patent Application Laid-Open No. 62-192566, Japanese Patent Application Laid-Open No. 2002-25812, and International Publication Pamphlet No. 2006/112403). However, the rare-earth magnets tend to be poor in corrosion resistance, since they are mainly composed of rare-earth elements which are easy to oxidize. Therefore, protective layers made of resins, plating, and the like are often provided on surfaces of magnet matrixes in order to improve the corrosion resistance of the rare-earth magnets.

SUMMARY OF THE INVENTION

However, complete corrosion resistance has not always been obtained in the rare-earth magnets having protective layers formed on their surfaces. This is because steam penetrates through the protective layers under a high-temperature, high-humidity environment, so as to reach the magnet matrixes, thereby letting them corrode.

In view of such a problem of the prior art, it is an object of the present invention to provide a rare-earth magnet which is excellent in corrosion resistance and a method of manufacturing the rare-earth magnet. It is another object of the present invention to provide a rotator which can keep superb performances over a long period.

For achieving the above-mentioned object, the rare-earth magnet in accordance with the present invention is an R-T-B-based rare-earth magnet containing a rare-earth element R, a transition metal element T, and boron B; wherein the rare-earth magnet further contains Cu and Co, while having a Cu concentration distribution with a gradient along a direction from a surface of the rare-earth magnet to the inside thereof, Cu having a higher concentration on the surface side of the rare-earth magnet than on the inside thereof, and a Co concentration distribution with a gradient along a direction from the surface of the rare-earth magnet to the inside thereof, Co having a higher concentration on the surface side of the rare-earth magnet than on the inside thereof.

The present invention improves the corrosion resistance of the rare-earth magnet.

The rare-earth magnet in accordance with the present invention may further contain Al, while having an Al concentration distribution with a gradient along a direction from the surface of the rare-earth magnet to the inside thereof, Al having a higher concentration on the surface side of the rare-earth magnet than on the inside thereof.

The rare-earth magnet having the above-mentioned Al concentration distribution also improves its corrosion resistance.

The rare-earth magnet of the present invention may be a rare-earth magnet comprising a crystal particle group of an R—Fe—B-based alloy containing the rare-earth element R; wherein an alloy containing R, Cu, Co, and Al exists in an R-rich phase included at a grain-boundary triple junction of crystal particles located in a surface part of the rare-earth magnet, while the total of Cu, Co, and Al contents in the R-rich phase is at least 13 atom %. This can also inhibit grain-boundary phases of the rare-earth magnet from occluding hydrogen and improve the corrosion resistance of the rare-earth magnet. Here, the crystal particle group means a plurality of crystal particles.

The inventors studied mechanisms by which steam corrodes magnet matrixes and, as a result, have found that hydrogen generated by a corrosion reaction is occluded by R-rich phases existing in grain boundaries in the magnet matrixes, so as to accelerate the change from the R-rich phases to oxides, whose accompanying volume expansion causes main-phase particles to drop out, whereby corrosion progresses at an accelerated rate within the magnets. Here, the R-rich phase means an alloy phase which contains at least a rare-earth element R, while having an R concentration (ratio of number of atoms) higher than that in the crystal particles (main phase) and a B concentration lower than that in the crystal particles. An example of R is Nd.

Therefore, the inventors diligently studied methods for inhibiting the R-rich phases in grain boundaries from occluding hydrogen and have found that diffusing Al into an R-rich phase near the surface of a magnet matrix can suppress the hydrogen occlusion and greatly improve the corrosion resistance, thereby achieving the present invention.

Preferably, in the present invention, the total of Cu and Al contents in the crystal particles is 2 atom % or less. When the total of Cu and Al contents does not exceed the upper limit mentioned above, not only the corrosion resistance but also a sufficient magnetic characteristic is imparted to the rare-earth magnet.

Preferably, in the present invention, the crystal particle group occupies at least 85 vol % of the whole rare-earth magnet. This provides the rare-earth magnet with a sufficient magnetic characteristic as well as the corrosion resistance.

The rotator of the present invention comprises the rare-earth magnet of the present invention. The rotator equipped with a rare-earth magnet excellent in corrosion resistance can keep superb performances over a long period even when used under a harsh environment.

A first method of manufacturing the rare-earth magnet in accordance with the present invention comprises the steps of attaching Cu to a surface of an R-T-B-based magnet matrix containing a rare-earth element R, a transition metal element T, and B; and heating the magnet matrix having Cu attached thereto at 480 to 650° C.; wherein the magnet matrix further contains Co. This can yield the rare-earth magnet of the present invention having the Cu and Co concentration distributions mentioned above.

A second method of manufacturing the rare-earth magnet in accordance with the present invention comprises the steps of attaching Al to a surface of an R-T-B-based magnet matrix containing a rare-earth element R, a transition metal element T, and B; and heating the magnet matrix having Al attached thereto at 540 to 630° C.; wherein the magnet matrix further contains Cu and Co. This can yield the rare-earth magnet of the present invention having the Cu, Co, and Al concentration distributions mentioned above.

The present invention can provide a rare-earth magnet which is excellent in corrosion resistance and a method of manufacturing the rare-earth magnet. The present invention can also provide a rotator which can keep superb performances over a long period.

DESCRIPTION OF THE PREFERRED EMBODIMENTS

Figure 1:
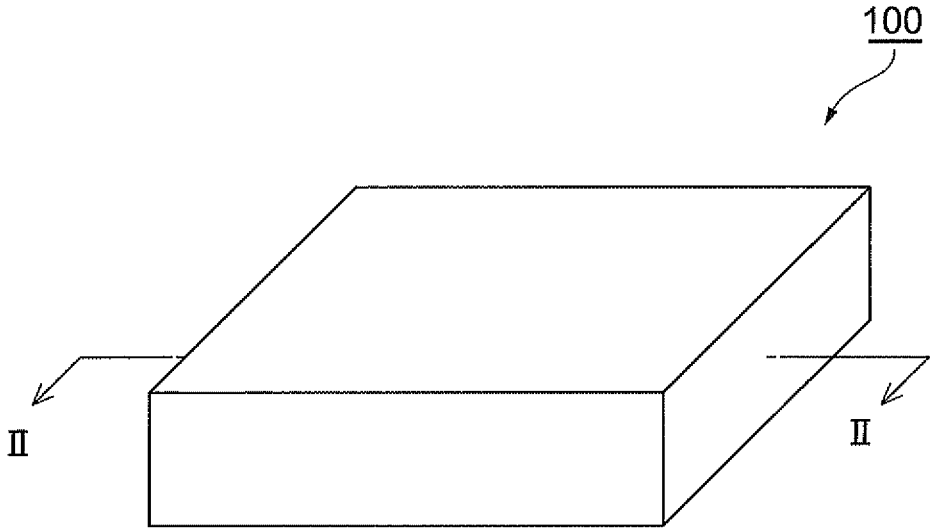
FIG. 1 is a perspective view of the rare-earth magnet in accordance with a first or second embodiment of the present invention.

In the following, preferred first and second embodiments of the present invention will be explained in detail with reference to the drawings. However, the present invention is not limited to the following embodiments. In the drawings, the same constituents will be referred to with the same signs, while omitting a part of the signs for the same constituents.

First Embodiment

Rare-Earth Magnet

Figure 2:
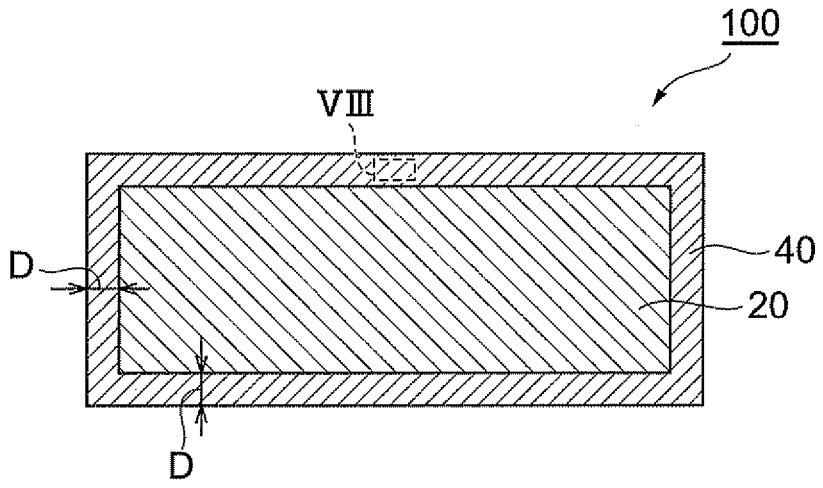
FIG. 2 is a sectional view of the rare-earth magnet taken along the line II-II of FIG. 1.

The rare-earth magnet 100 in accordance with the first embodiment illustrated in FIGS. 1 and 2 is an R-T-B-based rare-earth magnet containing a rare-earth element R, a transition metal element T, and B. The rare-earth element R may be at least one kind selected from the group consisting of La, Ce, Pr, Nd, Pm, Sm, Eu, Gd, Tb, Dy, Ho, Er, Tm, Yb, and Lu. In particular, the rare-earth magnet 100 preferably contains both Nd and Pr as the rare-earth element R. Preferably, the rare-earth magnet contains Co and Fe as the transition metal element T. By containing these elements, the rare-earth magnet 100 remarkably improves its residual magnetic flux density and coercive force. The rare-earth magnet 100 may further contain other elements such as Mn, Nb, Zr, Ti, W, Mo, V, Ga, Zn, Si, and Bi when necessary.

The rare-earth magnet 100 further contains Cu and Co. The Cu concentration distribution in the rare-earth magnet 100 has a gradient along a direction from a surface of the rare-earth magnet 100 to the inside thereof. Cu has a higher concentration on the surface side of the rare-earth magnet 100 than on the inside thereof. That is, the Cu concentration in the rare-earth magnet 100 is the highest on the surface side of the rare-earth magnet 100 and decreases as the distance from the surface of the rare-earth magnet 100 increases toward the inside (center part 20). The Co concentration distribution in the rare-earth magnet 100 has a gradient along a direction from the surface of the rare-earth magnet 100 to the inside thereof, so that Co has a higher concentration on the surface side of the rare-earth magnet 100 than on the inside thereof. That is, the Co concentration in the rare-earth magnet 100 is the highest on the surface side of the rare-earth magnet 100 and decreases as the distance from the surface of the rare-earth magnet 100 increases toward the inside (center part 20).

The inventors studied mechanisms by which steam corrodes magnets and, as a result, have found that hydrogen generated by a corrosion reaction is occluded by R-rich phases existing in grain boundaries in the magnets, so as to accelerate the change from the R-rich phases to oxides, whose accompanying volume expansion causes main-phase particles of the magnet to drop out therefrom, whereby corrosion progresses at an accelerated rate within the magnets. Here, the R-rich phase means a phase in which the rare-earth element R is the element having the highest concentration (ratio of number of atoms) in the elements constituting the phase. An example of R is Nd.

Therefore, the inventors diligently studied methods for inhibiting the R-rich phases in grain boundaries from occluding hydrogen and have found that making each of Cu and Co concentrations higher in the vicinity of the surface of a magnet than on the inside thereof can suppress the hydrogen occlusion and greatly improve the corrosion resistance, thereby achieving the present invention. On the other hand, an appropriate amount of Cu distributed throughout the rare-earth magnet 100 can improve the coercive force of the rare-earth magnet 100, while the coercive force and residual magnetic flux density decrease in areas where the Cu concentration is too high. Therefore, the first embodiment provides an area where each of the Cu and Co concentration distributions has a gradient, i.e., a layer in which Cu and Co are concentrated (high concentration layer 40), on the surface side of the rare-earth magnet 100. This can improve the corrosion resistance of the rare-earth magnet 100 without losing its coercive force and residual magnetic flux density.

Preferably, the Cu content in the rare-earth magnet 100 is 0.01 to 1 wt % of the whole rare-earth magnet 100. When the Cu content is too high, the residual ferromagnetic density of the rare-earth magnet 100 tends to decrease. However, the effects of the present invention are achieved even when the Cu content exceeds the upper limit mentioned above. The Co content in the rare-earth magnet 100 may be about 0.1 to 10 wt % of the whole rare-earth magnet 100.

The thickness D of the high concentration layer 40 may be about 10 to 1000 μm, though not limited in particular. This makes it easier for the rare-earth magnet 100 to attain both sufficient corrosion resistance and magnetic characteristic at the same time. The thickness D of the high concentration layer 40 is substantially synonymous with the width of the area where each of the Cu and Co concentration distributions has a gradient. The thickness D or the width of the area where the concentration has a gradient means a value in a direction perpendicular to the surface of the rare-earth magnet 100.

The rare-earth magnet 100 has a length of about 1 to 200 mm, a width of about 1 to 200 mm, and a height of about 1 to 30 mm, though not restricted in particular in terms of sizes. The rare-earth magnet 100 may also be shaped like a ring or disk without being restricted to the rectangular parallelepiped illustrated in FIGS. 1 and 2.

Preferably, the rare-earth magnet 100 further contains Al. Preferably, the Al concentration in the rare-earth magnet 100 has a gradient along a direction from the surface of the rare-earth magnet 100 to the inside thereof, so that Al has a higher concentration on the surface side of the rare-earth magnet 100 than on the inside thereof. That is, it will be preferred if the Al concentration in the rare-earth magnet 100 is the highest on the surface side of the rare-earth magnet 100 and decreases as the distance from the surface of rare-earth magnet 100 increases toward the inside (center part 20). Thus locally distributing Al together with Cu and Co in the surface of the rare-earth magnet 100 makes it harder for the surface to occlude hydrogen, whereby the rare-earth magnet 100 is easier to improve its corrosion resistance.

Distributing Al not only in the surface of the rare-earth magnet 100 but throughout the inside thereof tends to worsen its magnetic characteristic. Therefore, the width of the area where the Al concentration distribution has a gradient is preferably 1000 μm or less from the surface of the rare-earth magnet 100. On the other hand, the width of the area where the Al concentration distribution has a gradient is preferably at least 100 μm, more preferably at least 200 μm, from the surface of the rare-earth magnet 100. This makes it easier for the rare-earth magnet 100 to attain both corrosion resistance and magnetic characteristic at the same time.

Preferably, the Al content in the rare-earth magnet 100 is 0.01 to 1.5 wt %. When the Al content is too high, the residual magnetic flux density of the rare-earth magnet 100 tends to deteriorate. However, the effects of the present invention are achieved even when the Al content exceeds the upper limit mentioned above.

Preferably, the rare-earth magnet 100 further contains Ni. Preferably, the Ni concentration distribution in the rare-earth magnet 100 has a gradient along a direction from the surface of the rare-earth magnet 100 to the inside thereof, so that Ni has a higher concentration on the surface side of the rare-earth magnet 100 than on the inside thereof. That is, it will be preferred if the Ni concentration in the rare-earth magnet 100 is the highest on the surface side of the rare-earth magnet 100 and decreases as the distance from the surface of the rare-earth magnet 100 increases toward the inside (center part 20). This makes it easier for the rare-earth magnet 100 to improve its corrosion resistance. The Ni content in the rare-earth magnet 100 may be about 0.001 to 0.1 wt % of the whole rare-earth magnet 100.

Preferably, the gradient of the Cu concentration distribution is 0.01 to 5 wt %/mm. Preferably, the gradient of the Co concentration distribution is 0.01 to 5 wt %/mm. Preferably, the gradient of the Al concentration distribution is 0.01 to 5 wt %/mm. Preferably, the gradient of the Ni concentration distribution is 0.001 to 0.1 wt %/mm. When the gradients in the concentration distributions of elements fall within the respective numeric ranges mentioned above, the rare-earth magnet 100 is easier to improve its corrosion resistance. Each gradient is in a direction which is perpendicular to the surface of the rare-earth magnet 100 and directed from the surface of the rare-earth magnet 100 to the inside (center part 20). The value of each gradient is an average concentration gradient from a position where the depth from the surface of the rare-earth magnet 100 is 20 μm to a position at ¼ of the thickness of the magnet. The value of each concentration (wt %) is based on unit weight of the rare-earth magnet 100.

The rare-earth magnet 100 may further comprise a protective layer on its surface if necessary. Any protective layer can be employed without any restrictions in particular as long as it is typically formed as a layer for protecting the surface of a rare-earth magnet. Examples of the protective layer include resin layers formed by coating or vapor deposition polymerization, metal layers formed by plating or vapor-phase methods (gas-phase methods), inorganic layers formed by coating or vapor-phase methods, oxide layers, and chemically converted layers. When a protective layer is formed on the surface of the magnet, however, a stress occurring between the protective layer and the magnet may lower the magnet characteristic (squareness). The first embodiment overcomes the problem concerning the stress, since the high concentration layer 40 improves the corrosion resistance of the magnet even when there is no protective layer.

Methods for measuring the composition of the rare-earth magnet 100 and concentration distributions of the elements are not limited in particular; an electron probe micro-analyzer (EPMA), laser ablation inductively coupled plasma mass spectrometry (LA-ICP-MS), or the like may be used.

Method of Manufacturing Rare-Earth Magnet of First Embodiment

First Manufacturing Method

The first manufacturing method of the rare-earth magnet initially casts a material alloy, so as to yield an ingot. As the material alloy, one containing a rare-earth element R, Co, and B may be used. The material alloy may further contain elements such as a transition metal element T (e.g., Fe) other than Co, Cu, Ni, Mn, Al, Nb, Zr, Ti, W, Mo, V, Ga, Zn, Si, and Bi. The chemical composition of the ingot may be adjusted according to that of a main phase of the rare-earth magnet to be obtained finally.

The ingot is roughly pulverized by a disc mill or the like, so as to yield an alloy powder having a particle size of about 10 to 100 μm. The alloy powder is finely pulverized by a jet mill or the like, so as to yield a finer alloy powder having a particle size of about 0.5 to 5 μm. Thus obtained alloy powder is molded under pressure in a magnetic field. Preferably, the intensity of the magnetic field applied to the alloy powder at the time of molding is 800 kA/m or higher. Preferably, the pressure applied to the alloy powder at the time of molding is about 10 to 500 MPa. Any of uniaxial pressing and isostatic pressing such as CIP may be used as a molding method. The resulting molded product is fired, so as to form a sintered product (magnet matrix). The firing temperature may be about 1000 to 1200° C. The firing time may be about 0.1 to 100 hr. The firing step may be carried out a plurality of times. The firing step is preferably performed in a vacuum or in an inert gas atmosphere such as Ar gas.

Preferably, the sintered product is subjected to aging. In the aging, the sintered product may be heat-treated at about 450 to 950° C. In the aging, the sintered product may be heat-treated for about 0.1 to 100 hr. The aging may be performed in an inert gas atmosphere. Such aging further improves the coercive force of the rare-earth magnet. The aging may be constituted by multistage heat treatment steps. In the aging constituted by two stages of heat treatment, for example, the first stage of heat treatment may heat the sintered product for 0.1 to 50 hr at a temperature of at least 700° C. but lower than the sintering temperature. The second stage of heat treatment may heat the sintered product at 450 to 700° C. for 0.1 to 100 hr.

The sintered product (magnet matrix) obtained by the foregoing process comprises, at least, a main phase made of an R-T-B-based alloy and an R-rich phase, mainly composed of R, existing in a grain boundary. The sintered product further contains Co.

When necessary, the resulting sintered product may be processed into a predetermined form. Examples of the processing method include shaping such as cutting and shaving and chamfering such as barrel polishing. However, such processing is not always necessary.

Thus obtained magnet matrix may be washed as appropriate in order to remove irregularities on the surface and impurities or the like attached to the surface. A preferred example of the washing method is pickling (etching) with an acid solution. The pickling makes it easier to dissolve away the irregularities and impurities on the surface of the magnet matrix, so as to yield the magnet matrix with a smooth surface, whereby Cu is more likely to diffuse in a heat treatment step which will be explained later.

Preferred as the acid to be used in the pickling is nitric acid, which is an oxidizing acid whose hydrogen generation is small. The nitric acid concentration in the processing liquid is preferably 1 N or less, 0.5 N or less in particular. The amount of dissolution of the surface of the magnet matrix by such pickling is preferably 5 μm or greater, more preferably 10 to 15 μm, in terms of the average thickness from the surface. This can substantially completely remove the modified layers and oxide layers formed by the surface processing of the surface of the magnet matrix, thereby making it easier for Cu to diffuse in the heat treatment step that will be explained later.

After washing the pickled magnet matrix with water, so as to remove therefrom the processing liquid used for the pickling, the magnet matrix is preferably washed with ultrasonic waves in order to completely remove small amounts of undissolved matters and residual acid components remaining on the surface. The ultrasonic washing can be performed in pure water whose amount of chlorine ions which rust the surface of the magnet matrix is very small or an alkaline solution, for example. After the ultrasonic washing, the magnet matrix may be washed with water if necessary.

Subsequently, elemental Cu, a Cu alloy, or a Cu compound is attached to the surface of the magnet matrix. An example of methods for attaching Cu is one uniformly coating the whole surface of the magnet matrix with a coating liquid in which particles made of Cu are dispersed. The Cu particles to be attached to the surface of the magnet matrix preferably have a particle size of 50 μm or less. When the Cu particle size is too large, it may be problematic in that Cu is harder to diffuse into the magnet matrix. Preferably, the coating liquid contains a resin binder. The coating liquid containing the resin binder increases the bonding strength of particles to the magnet matrix, thereby making them harder to drop out. Cu may be attached to the surface of the magnet matrix by techniques such as plating and vapor-phase methods.

The magnet matrix having Cu attached to its surface is heated. This thermally diffuses Cu into the magnet matrix from the surface of the magnet matrix through grain-boundary phases and the like, while Co contained in the grain-boundary phases and the like within the magnet matrix migrates to the vicinity of the surface of the magnet matrix so as to be segregated as being induced by the diffusion of Cu. This heating step generates a gradient of the Cu concentration distribution on the surface side of the rare-earth magnet 100. The Cu concentration is higher on the surface side of the rare-earth magnet 100 than on the inside thereof. The heating step also generates a gradient of the Co concentration distribution on the surface side of the rare-earth magnet 100. The Co concentration is higher on the surface side of the rare-earth magnet 100 than on the inside thereof. The high concentration layer 40 is thus formed. On the other hand, the center part 20 having a uniform composition whose Cu and Co concentrations are substantially constant but lower than those in the high concentration layer 40 is formed within the magnet matrix where Cu attached to the surface thereof did not diffuse. The foregoing steps complete the rare-earth magnet 100 of the first embodiment.

The magnet matrix having Cu attached to the surface is heated at 480 to 650° C. When the heating temperature is too high, Cu may thermally diffuse not only into the surface but throughout the magnet matrix or melt and react with the main phase (R-T-B-based alloy) of the magnet matrix, thereby forming an alloy. As a result, the corrosion resistance and magnetic characteristic of the rare-earth magnet deteriorate. When the heating temperature is too low, Cu may fail to diffuse sufficiently into the magnet matrix, thereby making it harder to generate gradients of Cu and Co concentration distributions on the surface side of the rare-earth magnet 100. The heating time for the magnet matrix having Cu attached to the surface is preferably 10 to 600 min. Cu tends to be harder to diffuse sufficiently into the magnet matrix when the heating time is too short than when the heating time falls within the numeric range mentioned above. Cu tends to thermally diffuse into not only the surface but also a deeper part of the magnet matrix when the heating time is too long than when the heating time falls within the numeric range mentioned above. However, the rare-earth magnet of the first embodiment can be obtained even when the heating time falls outside of the above-mentioned numeric range.

Preferably, the magnet matrix heated by the above-mentioned heat treatment is rapidly cooled at a cooling rate of 30° C./min or higher. This makes it easier to generate gradients of Cu and Co concentration distributions on the surface side of the rare-earth magnet 100.

The diffusion length of Cu from the magnet matrix surface and the Cu and Co concentration gradients can be controlled as appropriate according to the respective contents of Cu and Co in the material alloy, the amount of Cu to be attached to the surface of the magnet matrix, the heating temperature or heating time for the magnet matrix having Cu attached to the surface, and the like. The diffusion length of Cu from the magnet matrix surface substantially coincides with the thickness D of the high concentration layer 40.

Preferably, the rare-earth magnet is subjected to aging as with the magnet matrix mentioned above. The aging further improves the coercive force of the rare-earth magnet. Preferably, the aging temperature does not exceed the heating temperature required for thermally diffusing Cu. Preferably, the rare-earth magnet heated by the aging is rapidly cooled at a cooling rate of 30° C./min or higher. This makes it easier for the rare-earth magnet to improve its magnetic characteristic.

After heating the magnet matrix having Cu attached to the surface, Cu and the like remaining on the surface of the rare-earth magnet may be removed by polishing or etching. A protective layer may be formed on the surface of the rare-earth magnet. Any protective layer can be employed without any restrictions in particular as long as it is typically formed as a layer for protecting the surface of a rare-earth magnet. Examples of the protective layer include resin layers formed by coating or vapor deposition polymerization, metal layers formed by plating or vapor-phase methods, inorganic layers formed by coating or vapor-phase methods, oxide layers, and chemically converted layers.

Second Manufacturing Method

The second manufacturing method of the rare-earth magnet initially casts a material alloy, so as to yield an ingot. As the material alloy, one containing a rare-earth element R, B, Cu, and Co may be used. The material alloy may further contain elements such as a transition metal element T (e.g., Fe) other than Co, Al, Ni, Mn, Nb, Zr, Ti, W, Mo, V, Ga, Zn, Si, and Bi when necessary. The chemical composition of the ingot may be adjusted according to that of a main phase of the rare-earth magnet to be obtained finally.

The ingot is roughly pulverized as in the first manufacturing method, so as to yield an alloy powder. The alloy powder is finely pulverized as in the first manufacturing method, so as to yield a finer alloy powder. The finer alloy powder is molded under pressure in a magnetic field as in the first manufacturing method. The resulting molded product is fired as in the first manufacturing method, so as to form a sintered product (magnet matrix).

Preferably, the sintered product is subjected to aging as in the first manufacturing method.

The sintered product (magnet matrix) obtained by the foregoing process comprises, at least, a main phase constituted by an R-T-B-based alloy and an R-rich phase, mainly composed of a rare-earth element R, existing in grain boundaries. The sintered product also contains Cu and Co.

The magnet matrix may be processed and washed as in the first manufacturing method if necessary.

Elemental Al, an Al alloy, or an Al compound is attached to the surface of the magnet matrix. An example of methods for attaching Al is one uniformly coating the whole surface of the magnet matrix with a coating liquid in which particles (e.g., flat powder) made of Al are dispersed. The Al particles to be attached to the surface of the magnet matrix preferably have a particle size of 50 μm or less. When the Al particle size is too large, it may be problematic in that Al is harder to diffuse into the magnet matrix. Preferably, the coating liquid contains a resin binder because of the same reason as with the first manufacturing method. Al may be attached to the surface of the magnet matrix by techniques such as plating and vapor-phase methods. Cu may be attached to the surface of the magnet matrix together with Al.

The magnet matrix having Al attached to its surface is heated. This thermally diffuses Al into the magnet matrix from the surface of the magnet matrix through grain-boundary phases and the like, while Cu and Co contained in the grain-boundary phases and the like within the magnet matrix migrate to the vicinity of the surface of the magnet matrix so as to be segregated as being induced by the diffusion of Al. This heating step generates a gradient of the Al concentration distribution on the surface side of the rare-earth magnet 100. The Al concentration is higher on the surface side of the rare-earth magnet 100 than on the inside thereof. The heating step also generates a gradient of the Cu concentration distribution on the surface side of the rare-earth magnet 100. The Cu concentration is higher on the surface side of the rare-earth magnet 100 than on the inside thereof. The heating step further generates a gradient of the Co concentration distribution on the surface side of the rare-earth magnet 100. The Co concentration is higher on the surface side of the rare-earth magnet 100 than on the inside thereof. The high concentration layer 40 is thus formed. On the other hand, the center part 20 having a uniform composition whose Al, Cu, and Co concentrations are substantially constant but lower than those in the high concentration layer 40 is formed within the magnet matrix where Al attached to the surface thereof did not diffuse. The foregoing steps complete the rare-earth magnet 100 of the first embodiment.

The magnet matrix having Al attached to the surface is heated at 540 to 630° C. When the heating temperature is too high, Al whose melting point is about 660° C. may melt and react with the main phase (R-T-B-based alloy) of the magnet matrix so as to yield an alloy, or thermally diffuse not only into the surface but throughout the magnet matrix. As a result, the corrosion resistance and magnetic characteristic of the rare-earth magnet deteriorate. When the heating temperature is too low, Al may fail to diffuse sufficiently into the magnet matrix, thereby making it harder to generate gradients of Al, Cu, and Co concentration distributions on the surface side of the rare-earth magnet 100. The heating time for the magnet matrix having Al attached to the surface is preferably 10 to 600 min. Al tends to be harder to diffuse sufficiently into the magnet matrix when the heating time is too short than when the heating time falls within the above-mentioned numeric range. Al tends to thermally diffuse into not only the surface but also a deeper part of the magnet matrix when the heating time is too long than when the heating time falls within the numeric range mentioned above. However, the rare-earth magnet of the first embodiment can be obtained even when the heating time falls outside of the above-mentioned numeric range.

Preferably, the magnet matrix heated by the above-mentioned heat treatment is rapidly cooled at a cooling rate of 30° C./min or higher. This makes it easier to generate gradients of Al, Cu, and Co concentration distributions on the surface side of the rare-earth magnet 100.

The diffusion length of Al from the magnet matrix surface and the Al, Cu, and Co concentration gradients can be controlled as appropriate according to the respective contents of Al, Cu, and Co in the material alloy, the amount of Al to be attached to the surface of the magnet matrix, the heating temperature or heating time for the magnet matrix having Al attached to the surface, and the like. The diffusion length of Al from the magnet matrix surface substantially coincides with the thickness D of the high concentration layer 40.

Preferably, the rare-earth magnet is subjected to aging as with the sintered product mentioned above. The aging further improves the coercive force of the rare-earth magnet. Preferably, the aging temperature does not exceed the heating temperature required for thermally diffusing Al. Preferably, the rare-earth magnet heated by the aging is rapidly cooled at a cooling rate of 30° C./min or higher. This makes it easier for the rare-earth magnet to improve its magnetic characteristic.

After heat-treating the magnet matrix having Al attached to the surface, Al and the like remaining on the surface of the rare-earth magnet may be removed by polishing or etching. A protective layer may be formed on the surface of the rare-earth magnet as in the first manufacturing method.

Rotator

Figure 3:
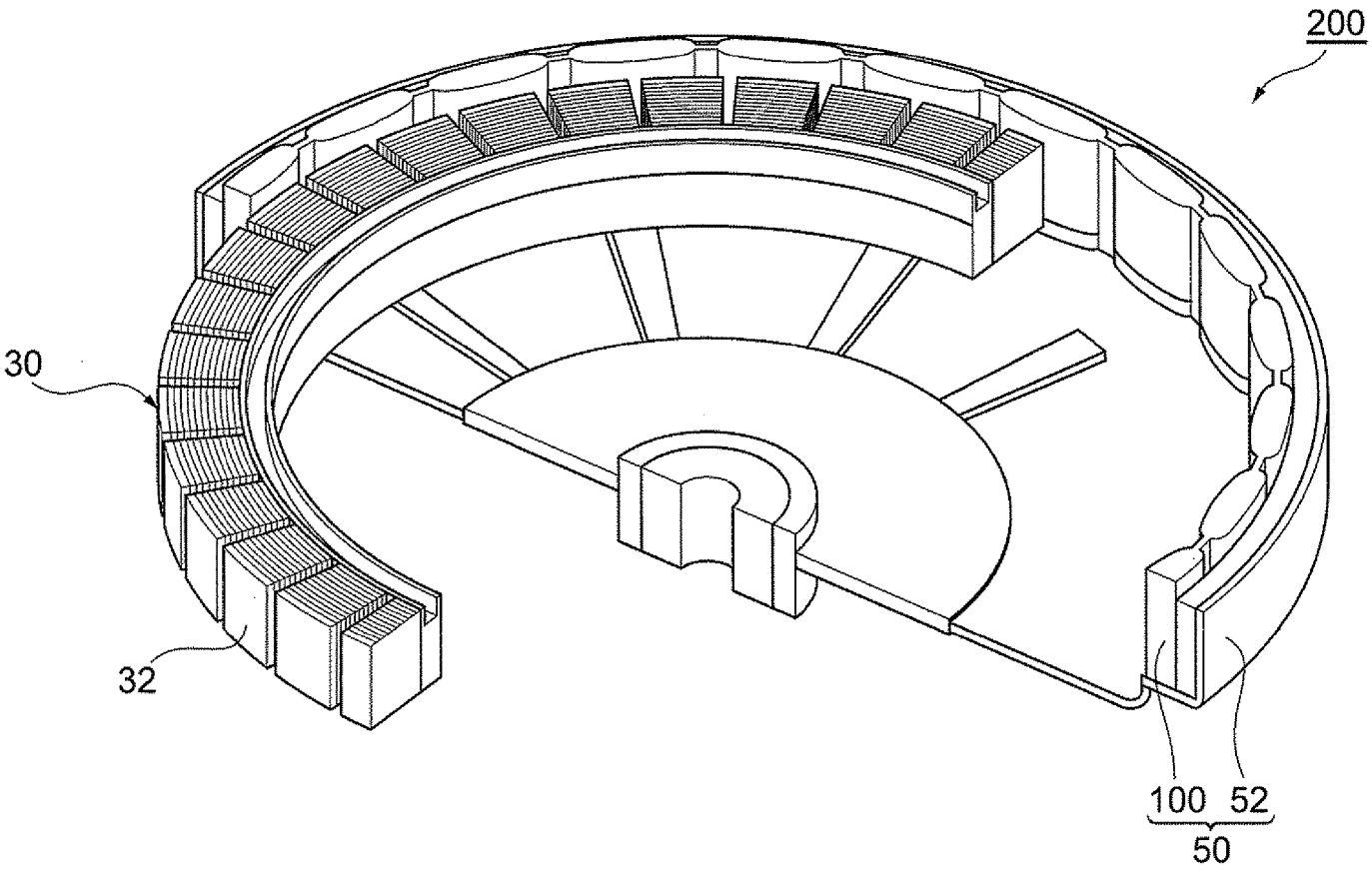
FIG. 3 is a perspective view schematically illustrating the rotator in accordance with an embodiment of the present invention.

FIG. 3 is an explanatory view illustrating the inner structure of the rotator (permanent magnet rotator) in accordance with the first embodiment. The rotator 200 of the first embodiment is a permanent magnet synchronous rotator (SPM rotator) comprising a cylindrical rotor 50 and a stator 30 arranged on the inside of the rotor 50. The rotor 50 comprises a cylindrical core 52 and a plurality of rare-earth magnets 100 arranged such that their N and S poles alternate along the inner peripheral face of the cylindrical core 52. The stator 30 has a plurality of coils 32 disposed along its inner peripheral face. The coils 32 are arranged such as to oppose the rare-earth magnets 100.

In the rotator 200, the rotor 50 is equipped with the rare-earth magnets 100 in accordance with the first embodiment. The rare-earth magnets 100 are excellent in corrosion resistance and thus can fully inhibit the magnetic characteristic from lowering with time. Therefore, the rotator 200 can keep superb performances over a long time. Except for the rare-earth magnets 100, the rotator 200 can be manufactured by a conventional method using typical rotator parts. Rotators using the rare-earth magnets 100 in accordance with the second embodiment, which will be explained later, instead of those in accordance with the first embodiment can also fully inhibit the magnetic characteristic from lowering with time and keep superb performances over a long time because of the same reason as with the first embodiment.

The rotator 200 may be a motor which converts electric energy into mechanical energy through an interaction between the field system of an electromagnet generated upon energization of the coils 32 and the field system caused by the permanent magnets 100. The rotator 200 may also be a generator which converts mechanical energy into electric energy through an electromagnetically induced interaction between the field system caused by the permanent magnets 100 and the coils 32.

Examples of the rotator 200 functioning as a motor include permanent magnet DC motors, linear synchronous motors, permanent magnet synchronous motors (SPM motors and IPM motors), and reciprocating motors. Examples of motors functioning as the reciprocating motors include voice coil motors and vibrating motors. Examples of the rotator 200 functioning as the generator include permanent magnet synchronous generators, permanent magnet dynamos, and permanent magnet AC generators. The rotators mentioned above are used in automobiles, industrial machines, home electrical appliances, and the like.

The first embodiment of the present invention will now be explained in more detail with reference to Examples 1 to 13, which do not restrict the first embodiment of the present invention.

Example 1

By powder metallurgy, an ingot having a composition constituted by 22.5 wt % of Nd, 5.2 wt % of Pr, 2.7 wt % of Dy, 0.5 wt % of Co, 0.3 wt % of Al, 0.07 wt % of Cu, 1.0 wt % of B, and the remainder of Fe was produced. The ingot was roughly pulverized, and the resulting rough powder was pulverized in an inert gas by a jet mill, so as to yield a finer powder having an average particle size of about 3.5 μm. The finer powder was caused to fill a mold and molded under pressure in a magnetic field, whereby a molded product was obtained. The molded product was fired in a vacuum and then subjected to aging, so as to yield a sintered product. The sintered product was cut out, so as to produce a magnet matrix having a size of 13 mm×8 mm×2 mm.

The surface of the magnet matrix was degreased. Subsequently, the magnet matrix was immersed in an aqueous 2% $HNO_3$ solution for 2 min and thereafter subjected to ultrasonic washing with water, so as to perform etching. A coating liquid in which Cu particles having an average particle size of 1 μM were dispersed was prepared. The etched surface of the magnet matrix was coated with the coating liquid by dip coating, so as to form a coating film on the whole surface of the magnet matrix. The coating film was dried for 20 min at 120° C. The total amount of Cu contained in the coating film formed on the magnet matrix surface was adjusted to 1 wt % of the whole magnet matrix.

The magnet matrix having the coating film was heated in an Ar atmosphere at 570° C. for 60 min and then rapidly cooled at 50° C./min, so as to cause Cu in the coating film to diffuse into the magnet matrix. The heated magnet matrix was aged for 1 hr in the Ar atmosphere at 500° C. and then rapidly cooled at 50° C./min. The reactants remaining on the surface of the aged magnet matrix were polished away, and then the surface of the magnet matrix was etched, whereby the rare-earth magnet of Example 1 was obtained.

Examples 2 to 7

In Examples 2 to 7, the magnet matrix having the coating film was heated in the Ar atmosphere at the respective temperatures (diffusion temperatures) listed in Table 1. Also, in Examples 2 to 7, the time (diffusion time) for heating the magnet matrix having the coating film was adjusted to the respective times listed in Table 1. In Table 1, "diffusion source" means the metal contained in the coating film formed on the magnet matrix surface.

In Example 4, no aging was performed after heating the magnet matrix having the coating film.

Except for the foregoing matters, the rare-earth magnets of Examples 2 to 7 were made by the same method as with Example 1.

Example 8

In Example 8, the surface of the magnet matrix produced by the same method as with Example 1 was degreased and etched. In Example 8, a coating liquid in which Al particles having an average particle size of 3 μm were dispersed instead of Cu particles was prepared. The etched surface of the magnet matrix was coated with this coating liquid by dip coating, so as to form a coating film on the whole surface of the magnet matrix. The total amount of Al contained in the coating film formed on the magnet matrix surface was adjusted to 0.3 wt % of the whole magnet matrix.

The magnet matrix having the coating film containing the Al particles was heated in an Ar atmosphere at 600° C. for 60 min and then rapidly cooled at 50° C./min, so as to cause Al in the coating film to diffuse into the magnet matrix. The heated magnet matrix was aged for 1 hr in the Ar atmosphere at 540° C. and then rapidly cooled at 50° C./min. The reactants remaining on the surface of the aged magnet matrix were polished away, and then the surface of the magnet matrix was etched, whereby the rare-earth magnet of Example 8 was obtained.

Examples 9 to 13

In Examples 9 to 13, the magnet matrix having the coating film containing the Al particles was heated in the Ar atmosphere at the respective temperatures (diffusion temperatures) listed in Table 1. Also, in Examples 9 to 13, the time (diffusion time) for heating the magnet matrix having the coating film was adjusted to the respective times listed in Table 1.

In Example 10, no aging was performed after heating the magnet matrix having the coating film.

In Examples 12 and 13, the total amount of Al contained in the coating film formed on the magnet matrix surface was adjusted to the respective values (coating amounts) listed in Table 1 with respect to the whole magnet matrix.

Except for the foregoing matters, the rare-earth magnets of Examples 9 to 13 were made by the same method as with Example 1.

Comparative Example 1

The rare-earth magnet of Comparative Example 1 was made by the same method as with Example 1 except that the steps subsequent to the etching of the magnet matrix surface were not carried out. That is, the rare-earth magnet of Comparative Example 1 was made without using any of Cu and Al particles.

Comparative Examples 2 and 3

In Comparative Examples 2 and 3, the magnet matrix having the coating film containing the Cu particles was heated in the Ar atmosphere at the respective temperatures (diffusion temperatures) listed in Table 1. In Comparative Example 2, no aging was performed after heating the magnet matrix having the coating film.

Except for the foregoing matters, the rare-earth magnets of Comparative Examples 2 and 3 were made by the same method as with Example 1.

Comparative Examples 4 and 5

In Comparative Examples 4 and 5, the magnet matrix having the coating film containing the Al particles was heated in the Ar atmosphere at the respective temperatures (diffusion temperatures) listed in Table 1. In Comparative Example 4, no aging was performed after heating the magnet matrix having the coating film.

Except for the foregoing matters, the rare-earth magnets of Comparative Examples 4 and 5 were made by the same method as with Example 8.

TABLE 1

| Table 1 | Diffusion source | Coating amount (wt %) | Diffusion temp (° C.) | Diffusion time (min) | Aging |
|---|---|---|---|---|---|
| Example 1 | Cu | 1 | 570 | 60 | 500° C., 1 hr |
| Example 2 | Cu | 1 | 540 | 60 | 500° C., 1 hr |
| Example 3 | Cu | 1 | 510 | 60 | 500° C., 1 hr |
| Example 4 | Cu | 1 | 480 | 240 | — |
| Example 5 | Cu | 1 | 600 | 60 | 500° C., 1 hr |
| Example 6 | Cu | 1 | 630 | 40 | 500° C., 1 hr |
| Example 7 | Cu | 1 | 650 | 20 | 500° C., 1 hr |
| Example 8 | Al | 0.3 | 600 | 60 | 540° C., 1 hr |
| Example 9 | Al | 0.3 | 570 | 60 | 540° C., 1 hr |
| Example 10 | Al | 0.3 | 540 | 240 | — |
| Example 11 | Al | 0.3 | 630 | 40 | 540° C., 1 hr |
| Example 12 | Al | 0.1 | 600 | 60 | 540° C., 1 hr |
| Example 13 | Al | 0.5 | 600 | 60 | 540° C., 1 hr |
| Comparative Example 1 | — | 0 | — | — | — |
| Comparative Example 2 | Cu | 1 | 420 | 60 | — |
| Comparative Example 3 | Cu | 1 | 700 | 60 | 500° C., 1 hr |
| Comparative Example 4 | Al | 0.3 | 510 | 60 | — |
| Comparative Example 5 | Al | 0.3 | 700 | 60 | 540° C., 1 hr |

Composition Analysis

By LA-ICP-MS, the respective concentration distributions of Cu, Co, Al, Ni, and Fe were measured in each of the rare-earth magnets of Examples and Comparative Examples. In the LA-ICP-MS, the respective sensitivity coefficients of the elements were computed beforehand, the detected counts of the elements were corrected with the sensitivity coefficients, and then the respective concentrations (unit: wt %) were calculated by normalization. The concentration values of the elements were based on the unit weight of each rare-earth magnet. In the LA-ICP-MS, 20 line scans were performed at intervals of 50 μm along the thickness direction of a fracture surface of each rare-earth magnet, and their average value was taken as the concentration distribution of each element. The thickness direction of the fracture surface of the rare-earth magnet is a direction from the surface of the rare-earth magnet to the inside thereof while being perpendicular to the surface of the rare-earth magnet. The following are details of apparatus employed in the LA-ICP-MS and measurement conditions thereof.

Apparatus

Laser ablation apparatus: LUV266X manufactured by New Wave Research

ICP-MS analyzer: Agilent 7500s manufactured by Agilent Technologies

The apparatus were connected to each other through a Tygon tube, and an Ar gas was used as a carrier gas.

Laser Conditions

Laser diameter: 50 μm

Frequency: 10 Hz

Power: 0.1 mJ

Laser scanning method: line scanning

Scanning rate: 25 μm/sec

Measurement Conditions

Measurement mass numbers: 72 kinds of mass numbers where m/z=2 to 260, wherein m is the mass number, and z is the electric charge. The above-mentioned 72 kinds of measurement mass numbers include the respective mass numbers of B (11), Al (27), Fe (57), Co (59), Cu (63), Pr (141), Nd (146), and Dy (163) which are main constituent elements (mass numbers) of magnets.

Mass number accumulation time: 0.01 sec for the above-mentioned main constituent elements, 0.005 sec for elements other than the main constituent elements, only the mass numbers used for quantitative determination being accumulated.

The rare-earth magnets of all the examples and all the comparative examples were seen to contain the same elements as with the ingot used for making the magnet matrix. Each rare-earth magnet was seen to contain Ni, which was included as impurities in the ingot.

Figure 4:
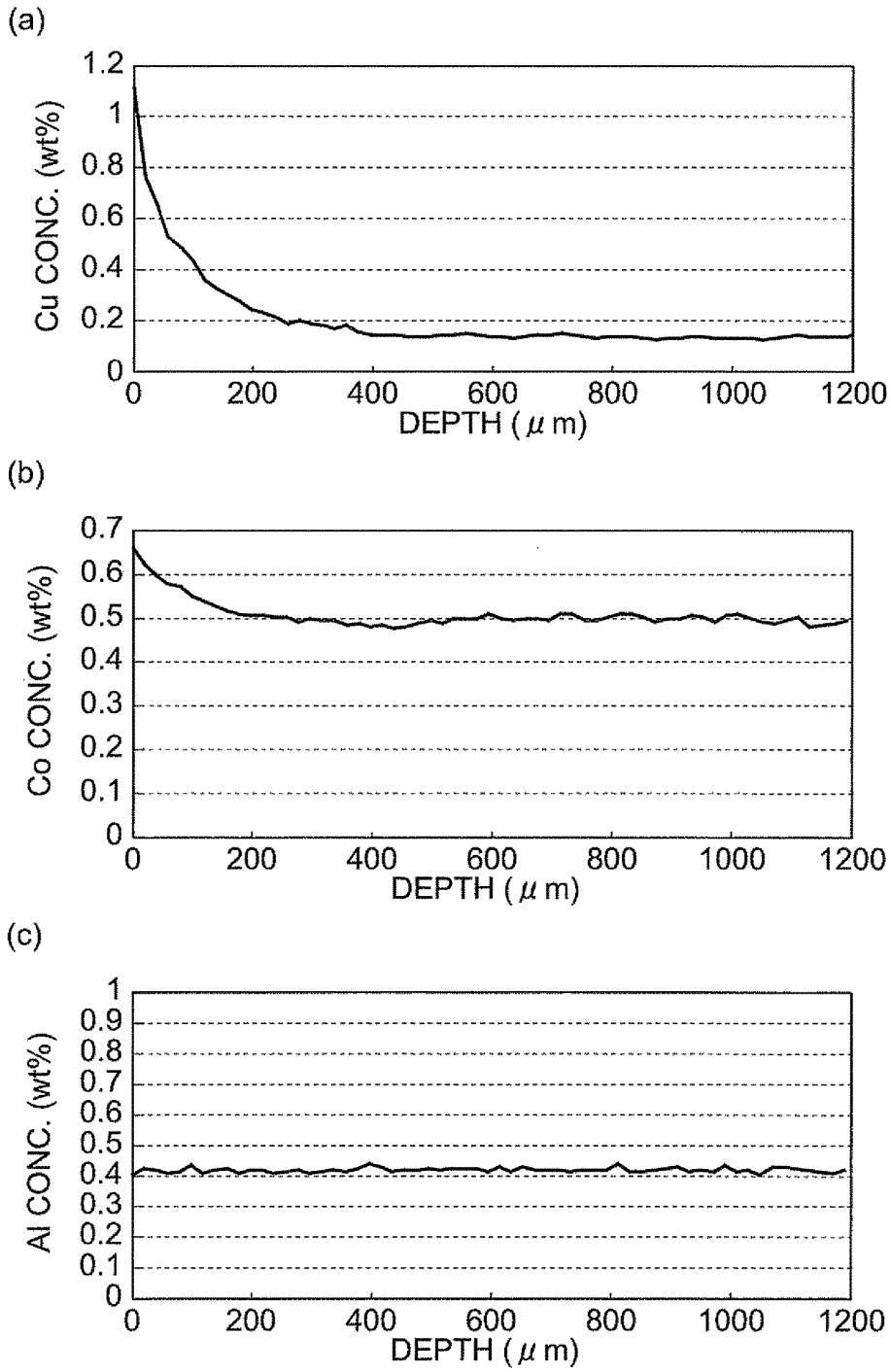
FIG. 4(*a*) is a chart illustrating the Cu concentration distribution in the rare-earth magnet of Example 1 of the present invention, FIG. 4(*b*) is a chart illustrating the Co concentration distribution in the rare-earth magnet of Example 1 of the present invention, and FIG. 4(*c*) is a chart illustrating the Al concentration distribution in the rare-earth magnet of Example 1 of the present invention.
Figure 5:
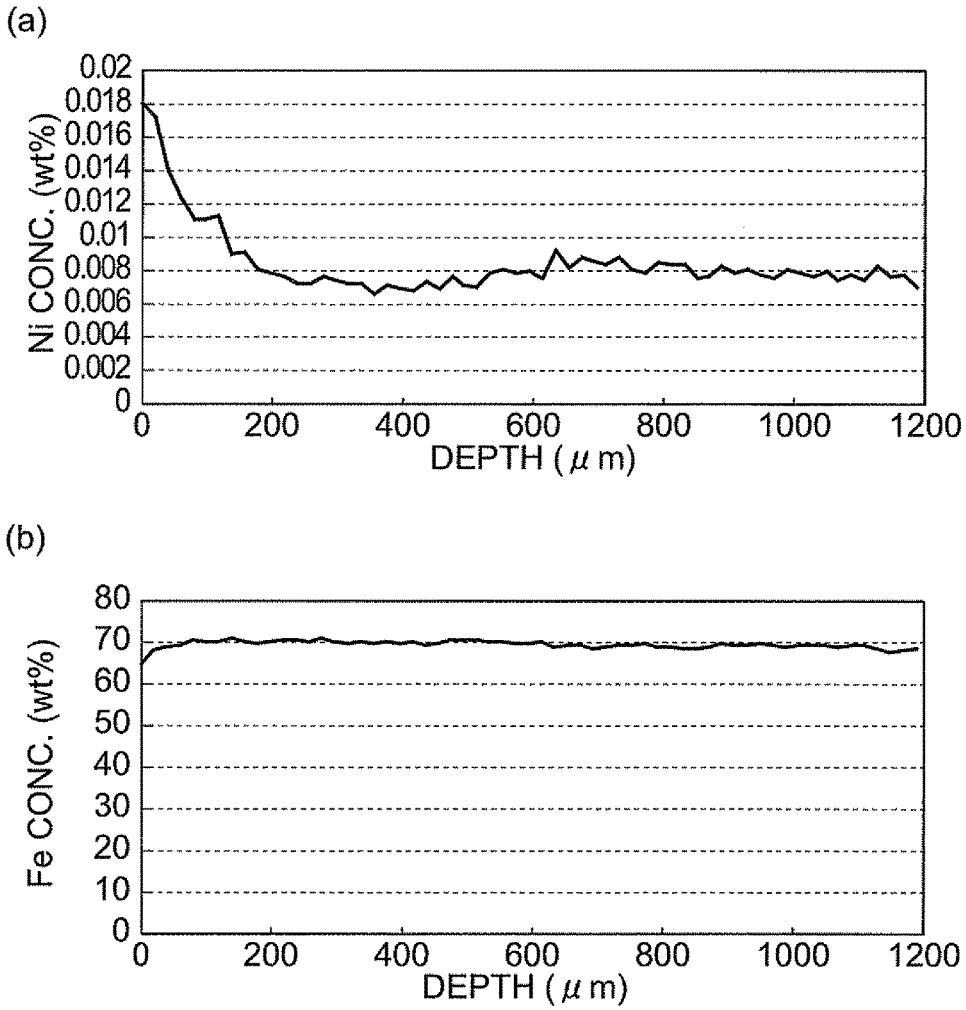
FIG. 5(*a*) is a chart illustrating the Ni concentration distribution in the rare-earth magnet of Example 1 of the present invention, and FIG. 5(*b*) is a chart illustrating the Fe concentration distribution in the rare-earth magnet of Example 1 of the present invention.
Figure 6:
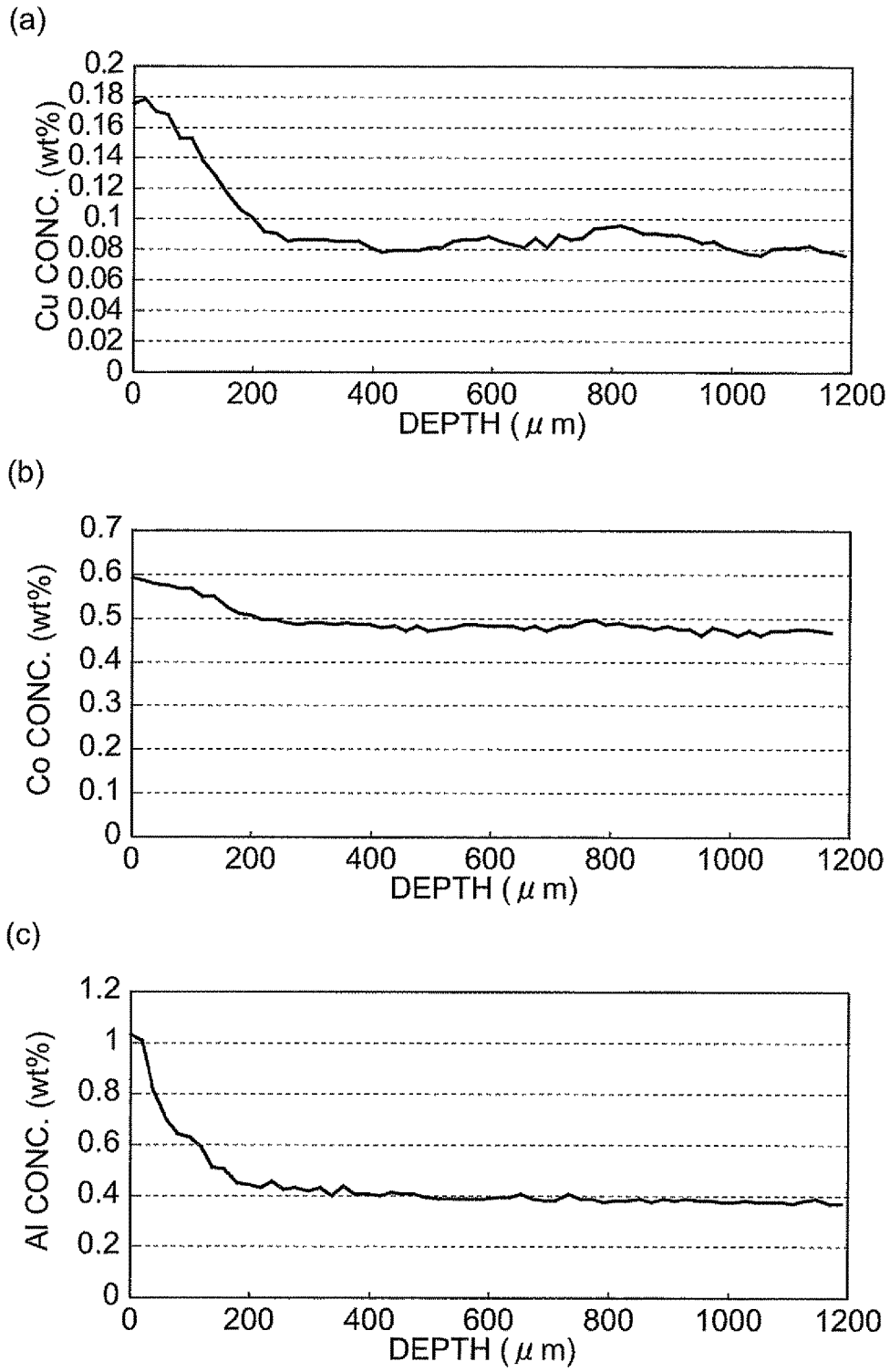
FIG. 6(*a*) is a chart illustrating the Cu concentration distribution in the rare-earth magnet of Example 8 of the present invention, FIG. 6(*b*) is a chart illustrating the Co concentration distribution in the rare-earth magnet of Example 8 of the present invention, and FIG. 6(*c*) is a chart illustrating the Al concentration distribution in the rare-earth magnet of Example 8 of the present invention.
Figure 7:
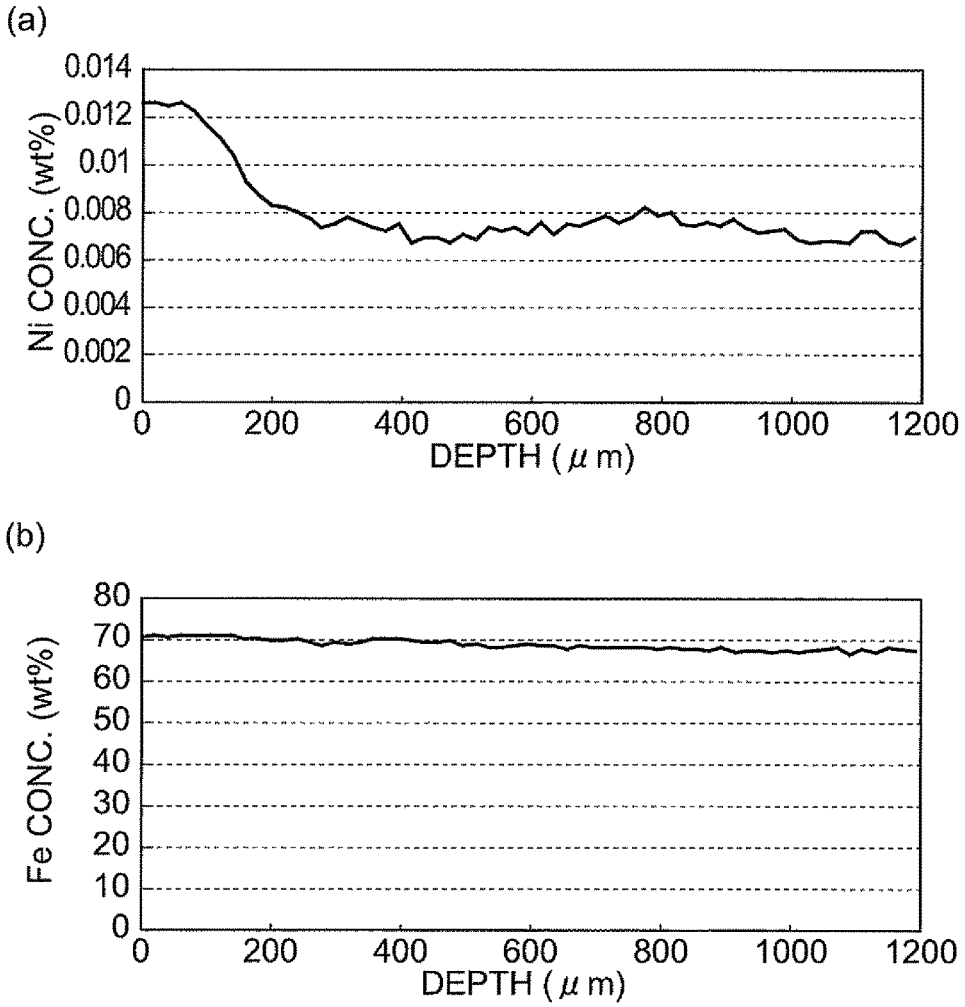
FIG. 7(*a*) is a chart illustrating the Ni concentration distribution in the rare-earth magnet of Example 8 of the present invention, and FIG. 7(*b*) is a chart illustrating the Fe concentration distribution in the rare-earth magnet of Example 8 of the present invention.

FIGS. 4(*a*), 4(*b*), 4(*e*), 5(*a*), and 5(*b*) illustrate the respective concentration distributions of elements in the rare-earth magnet of Example 1. FIGS. 6 (*a*), 6(*b*), 6(*c*), 7(*a*), and 7(*b*)

illustrate the respective concentration distributions of elements in the rare-earth magnet of Example 8. In each of the graphs, "wt %" as the unit of the ordinate means percent by weight. In each graph, "depth" as the unit of the abscissa means the distance from the surface of the rare-earth magnet.

The Cu concentration distribution in the rare-earth magnet of Example 1 was seen to have a gradient along the direction from the surface of the rare-earth magnet to the inside thereof, so that Cu had a concentration higher on the surface side of the rare-earth magnet than on the inside thereof. The Co and Ni concentration distributions in the rare-earth magnet of Example 1 were also seen to have gradients as in the case of Cu. The Al and Fe concentration distributions in the rare-earth magnet of Example 1 were seen to be substantially uniform with no gradients.

The Cu concentration distribution in each of the rare-earth magnets of Examples 2 to 7 was seen to have a gradient along the direction from the surface of the rare-earth magnet to the inside thereof, so that Cu had a concentration higher on the surface side of the rare-earth magnet than on the inside thereof. The Co and Ni concentration distributions in each of the rare-earth magnets of Example 2 to 7 were also seen to have gradients as in the case of Cu. The Al and Fe concentration distributions in each of the rare-earth magnets of Example 2 to 7 were seen to be substantially uniform with no gradients.

As a result of the analysis by the LA-ICP-MS, in each of directions perpendicular to the surfaces of the rare-earth magnets of Examples 1 to 7, the Cu, Co, and Ni concentration distributions were seen to have gradients along the direction from each surface to the inside, so that the concentrations of Cu, Co, and Ni were higher on each surface side than on the inside of the rare-earth magnet. In the center part in each of the rare-earth magnets of Examples 1 to 7, the composition was seen to be substantially uniform, so that the concentration distribution of each element had no gradient.

The Cu concentration distribution in the rare-earth magnet of Example 8 was seen to have a gradient along the direction from the surface of the rare-earth magnet to the inside thereof, so that Cu had a concentration higher on the surface side of the rare-earth magnet than on the inside thereof. The Co, Al, and Ni concentration distributions in the rare-earth magnet of Example 8 were also seen to have gradients as in the case of Cu. The Fe concentration distribution in the rare-earth magnet of Example 8 was seen to be substantially uniform with no gradient.

The Cu concentration distribution in each of the rare-earth magnets of Examples 9 to 13 was seen to have a gradient along the direction from the surface of the rare-earth magnet to the inside thereof, so that Cu had a concentration higher on the surface side of the rare-earth magnet than on the inside thereof. The Co, Al, and Ni concentration distributions in each of the rare-earth magnets of Examples 9 to 13 were also seen to have gradients as in the case of Cu. The Fe concentration distribution in each of the rare-earth magnets of Examples 9 to 13 was seen to be substantially uniform with no gradient.

As a result of the analysis by the LA-ICP-MS, in each of directions perpendicular to the surfaces of the rare-earth magnets of Examples 8 to 13, the Cu, Co, Al, and Ni concentration distributions were seen to have gradients along the direction from each surface to the inside, so that the concentrations of Cu, Co, Al, and Ni were higher on each surface side than on the inside of the rare-earth magnet. In the center part in each of the rare-earth magnets of Examples 8 to 13, the composition was seen to be substantially uniform, so that the concentration distribution of each element had no gradient.

As a result of the analysis by the LA-ICP-MS, the Co concentration distribution was seen to have no gradient in any of the rare-earth magnets of Comparative Examples 1 to 5. That is, the Co concentration was seen to be uniform in each of the rare-earth magnets of Comparative Examples 1 to 5.

The gradient of the concentration distribution of each element contained in the rare-earth magnet of each example was determined. Table 2 shows the results. Each of the values of gradients listed in Table 2 is an average concentration gradient from a position where the depth from the surface of the rare-earth magnet is 20 μm to a position at ¼ of the thickness of the magnet.

The thickness of the high concentration layer 40 was determined in each of the rare-earth magnets of Examples 1 to 7. In each of Examples 1 to 7, the Co concentration was measured at given 10 points in the center part of the rare-earth magnet, and the average value of Co concentration and the standard deviation σ were calculated from the values measured at the 10 points. Then, the thickness (width in a direction perpendicular to the magnet surface) of a region where points each yielding a Co concentration of (the average value+3σ) or greater were continuous was computed as the thickness of the high concentration layer 40. The high concentration layer 40 in each of Examples 1 to 7 substantially coincides with the region where the Cu and Co concentration distributions have gradients. Table 2 lists the thickness of the high concentration layer 40 in each example.

The thickness of the high concentration layer 40 was determined in each of the rare-earth magnets of Examples 8 to 13. In each of Examples 8 to 13, the Co concentration was measured at given 10 points in the center part of the rare-earth magnet, and the average value of Co concentration and the standard deviation σ were calculated from the values measured at the 10 points. Then, the thickness (width in a direction perpendicular to the magnet surface) of a region where points each yielding a Co concentration of (the average value+3σ) or greater were continuous was computed as the thickness of the high concentration layer 40. The high concentration layer 40 in each of Examples 8 to 13 substantially coincides with the region where the Cu, Co, and Al concentration distributions have gradients. Table 2 lists the thickness of the high concentration layer 40 in each example.

TABLE 2

| | High concentration layer thickness | Gradient (wt %/mm) | | | |
|---|---|---|---|---|---|
| Table 2 | (μm) | Cu | Co | Al | Ni |
| Example 1 | 160 | 1.01 | 0.24 | — | 0.014 |
| Example 2 | 120 | 0.98 | 0.26 | — | 0.015 |
| Example 3 | 40 | 1.09 | 0.07 | — | 0.004 |
| Example 4 | 60 | 0.79 | 0.06 | — | 0.004 |
| Example 5 | 400 | 0.75 | 0.05 | — | 0.004 |
| Example 6 | 500 | 0.65 | 0.11 | — | 0.008 |
| Example 7 | 600 | 0.71 | 0.09 | — | 0.005 |
| Example 8 | 240 | 0.2 | 0.24 | 0.82 | 0.013 |
| Example 9 | 100 | 0.15 | 0.19 | 1.19 | 0.014 |
| Example 10 | 80 | 0.08 | 0.09 | 1.04 | 0.008 |
| Example 11 | 200 | 0.29 | 0.34 | 0.72 | 0.023 |
| Example 12 | 240 | 0.21 | 0.28 | 0.8 | 0.015 |
| Example 13 | 180 | 0.27 | 0.3 | 1.07 | 0.019 |

Evaluation of Corrosion Resistance

The corrosion resistance of each of the rare-earth magnets of the examples and comparative examples was evaluated by a pressure cooker test (PCT). In the PCT, each rare-earth magnet was placed under an environment at a pressure of 2 atm, a temperature of 120° C., and a humidity of 100% RH for 300 hr, and thereafter the amount of weight loss was measured. Table 3 lists the amount of weight loss per unit surface area (unit: mg/cm$^2$) of each rare-earth magnet.

TABLE 3

| Table 3 | Weight loss (mg/cm$^2$) |
|---|---|
| Example 1 | 0 |
| Example 2 | 0 |
| Example 3 | 0.1 |
| Example 4 | 0.07 |
| Example 5 | 0 |
| Example 6 | 0 |
| Example 7 | 0 |
| Example 8 | 0 |
| Example 9 | 0 |
| Example 10 | 0.03 |
| Example 11 | 0 |
| Example 12 | 0 |
| Example 13 | 0 |
| Comparative Example 1 | 2.62 |
| Comparative Example 2 | 1.1 |
| Comparative Example 3 | 0.5 |
| Comparative Example 4 | 1.04 |
| Comparative Example 5 | 0.41 |

The amount of weight loss in the rare-earth magnet was seen to be smaller in each example than in each comparative example. That is, the rare-earth magnet of each example was seen to be superior to each comparative example in terms of the corrosion resistance.

Second Embodiment

Rare-Earth Magnet

Figure 8:
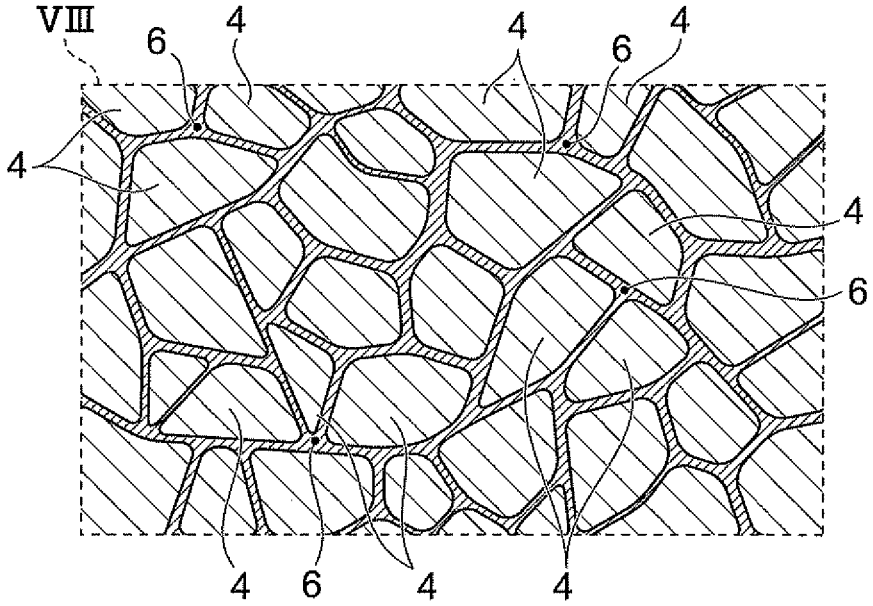
FIG. 8 is a schematic view enlarging a portion VIII of a surface part 40 of the rare-earth magnet illustrated in FIG. 2.

As illustrated in FIGS. 1, 2, and 8, the rare-earth magnet 100 of the second embodiment comprises a plurality of crystal particles 4 (main-phase particles). The main phase of the rare-earth magnet 100 is constituted by the crystal particles 4. The crystal particles 4 contain an R—Fe—B-based alloy as their main ingredient. An example of the R—Fe—B-based alloy is an $R_2Fe_{14}B$-based alloy. The rare-earth magnet 100 has a grain-boundary phase located between a plurality of crystal particles 4. The grain-boundary phase is constituted by an R-rich phase, a B-rich phase, an oxide phase, a carbide phase, or the like. The B-rich phase is a phase containing B by an amount greater than that contained in the particles constituting the crystal. The oxide phase is a phase containing 20% or more of oxygen by element ratio in the elements constituting the phase. The carbide phase is a phase containing 20% or more of carbon by element ratio in the elements constituting the phase.

The rare-earth magnet 100 has a length of about 1 to 200 mm, a width of about 1 to 200 mm, and a height of about 1 to 30 mm, though not restricted in terms of the size in particular. The average particle size of the crystal particles 4, which is not limited in particular, is about 1 to 20 μm. The rare-earth magnet 100 may also be shaped like a ring or disk without being restricted in particular.

The rare-earth element R may be at least one kind selected from the group consisting of La, Ce, Pr, Nd, Pm, Sm, Eu, Gd, Tb, Dy, Ho, Er, Tm, Yb, and Lu. The rare-earth element R is preferably at least one kind of Nd and Pr in particular. This remarkably improves the saturated magnetic flux density and coercive force of the rare-earth magnet 100.

The main and grain-boundary phases of the rare-earth magnet 100 may further contain other elements such as Co, Cu, Al, Ni, Mn, Nb, Zr, Ti, W, Mo, V, Ga, Zn, Si, and Bi when necessary.

Cu, Co, and Al are segregated in the R-rich phases included at grain-boundary triple junctions 6 located in the surface part 40 of the rare-earth magnet 100, so as to form an alloy containing R, Cu, Co, and Al. The grain-boundary triple junction means a grain-phase boundary surrounded by three or more crystal particles 4. A part of Al contained in the R-rich phase at the grain-boundary triple junction 6 may form an alloy with Fe. That is, the grain-boundary triple junction 6 may contain an alloy phase constituted by Fe and Al. In the following, the alloy containing R, Cu, Co, and Al will be referred to as "R—Cu—Co—Al alloy" when appropriate.

The respective contents of Cu, Co, and Al are much higher in the R-rich phases at the grain-boundary triple junctions 6 located in the surface part 40 of the rare-earth magnet 100 than in the main phase (crystal particle group). The total of the Cu, Co, and Al contents in the R-rich phases at the grain-boundary triple junctions 6 is 13 at % or higher. In the following, the R-rich phase existing at the grain-boundary triple junction 6, containing the R—Cu—Co—Al alloy, and having at least 13 at % in total of Cu, Co, and Al contents will be referred to as "R—Cu—Co—Al phase" when appropriate. In the R—Cu—Co—Al phase, the total of Cu, Co, and Al is 88 at % or less.

The R—Cu—Co—Al phase is characteristically hard to occlude hydrogen. Therefore, even when the surface of the rare-earth magnet is corroded by steam, so as to generate hydrogen, the R—Cu—Co—Al phase located in the surface part 40 of the rare-earth magnet 100 inhibits hydrogen from entering the R-rich phase within the rare-earth magnet and being occluded thereby. This restrains hydrogen and the R-rich phase from reacting with each other and thus makes it harder for the corrosion to advance from the surface of the rare-earth magnet to the inside. The corrosion resistance of the R—Cu—Co—Al phase seems to result from the high corrosion potential of the R—Cu—Co—Al alloy. For example, the R—Cu—Co—Al alloy has a corrosion potential higher than that of elemental Nd.

If the R—Cu—Co—Al phase is distributed not only in the surface part 40 but throughout the inside of the rare-earth magnet 100, it will be problematic in that the magnetic characteristic tends to deteriorate. Therefore, it will be preferred if the R—Cu—Co—Al alloy exists only in the surface part 40 of the rare-earth magnet 100. Specifically, it will be preferred if the R—Cu—Co—Al alloy exists only in a region of the rare-earth magnet 100 where the depth D from the outer surface is less than 500 μm. More preferably, the R—Cu—Co—Al alloy exists only in a region of the rare-earth magnet 100 where the depth D from the outer surface is 400 μm or less. This eliminates the problem mentioned above. The depth D corresponds to the thickness of the surface part 40. For attaining both sufficient corrosion resistance and magnetic characteristic at the same time, the thickness D of the surface part 40 is preferably at least 100 μm, more preferably at least 200 μm.

Preferably, the total of Co and Cu contents is higher in the surface part 40 of the rare-earth magnet 100 than in the center part thereof. This tends to make it easier for the rare-earth magnet 100 to improve the corrosion resistance.

Preferably, the total of Cu and Al contents in the crystal particles 4 is 2 at % or less. In other words, the total of Cu and Al contents in the main phase of the rare-earth magnet 100 is preferably 2 at % or less. When the Cu and Al contents in the main phase are too high, the saturated magnetic flux density of the rare-earth magnet 100 tends to deteriorate. Such a problem can be suppressed when the total of Cu and Al contents does not exceed the upper limit mentioned above. However, the effects of the present invention can be achieved even when the total of Cu and Al contents exceeds the above-mentioned upper limit.

Preferably, the ratio of the main phase constituted by the crystal particles 4 is at least 85 vol % of the whole rare-earth magnet 100. This provides the rare-earth magnet with a sufficient magnetic characteristic.

The rare-earth magnet 100 may further comprise a protective layer on its surface if necessary. Any protective layer can be employed without any restrictions in particular as long as it is typically formed as a layer for protecting the surface of a rare-earth magnet. Examples of the protective layer include resin layers formed by coating or vapor deposition polymerization, metal layers formed by plating or vapor-phase methods, inorganic layers formed by coating or vapor-phase methods, oxide layers, and chemically converted layers.

The Cu concentration distribution in the rare-earth magnet of the second embodiment may have a gradient along the direction from the surface of the rare-earth magnet to the inside so that Cu has a concentration higher on the surface side of the rare-earth magnet than on the inside thereof. The Co concentration distribution in the rare-earth magnet of the second embodiment may have a gradient along the direction from the surface of the rare-earth magnet to the inside so that Co has a concentration higher on the surface side of the rare-earth magnet than on the inside thereof.

Method of Manufacturing Rare-Earth Magnet of Second Embodiment

The method of manufacturing the rare-earth magnet of the second embodiment is substantially the same as the second manufacturing method of the first embodiment. When manufacturing the rare-earth magnet of the second embodiment, a material alloy is initially cast, so as to yield an ingot. As the material alloy, one containing a rare-earth element R, Fe, B, Cu, and Co may be used. The material alloy may further contain elements such as Al, Ni, Mn, Nb, Zr, Ti, W, Mo, V, Ga, Zn, Si, and Bi when necessary. The chemical composition of the ingot may be adjusted according to chemical compositions of main and grain-boundary phases of the rare-earth magnet to be obtained finally.

The ingot is roughly pulverized by a disc mill or the like, so as to yield an alloy powder having a particle size of about 10 to 100 μm. The alloy powder is finely pulverized by a jet mill or the like, so as to yield a finer alloy powder having a particle size of about 0.5 to 5 μm. Thus obtained finer alloy powder is molded under pressure in a magnetic field. Preferably, the intensity of the magnetic field applied to the alloy powder at the time of molding is 800 kA/m or higher. Preferably, the pressure applied to the alloy powder at the time of molding is about 10 to 500 MPa. Any of uniaxial pressing and isostatic pressing such as CIP may be used as a molding method. The resulting molded product is fired, so as to form a sintered product. The firing temperature may be about 1000 to 1200° C. The firing time may be about 0.1 to 100 hr. The firing step may be carried out a plurality of times. The firing step is preferably performed in a vacuum or in an inert gas atmosphere such as Ar gas.

Preferably, the sintered product is subjected to aging. In the aging, the sintered product may be heat-treated at about 450 to 950° C. In the aging, the sintered product may be heat-treated for about 0.1 to 100 hr. The aging may be performed in an inert gas atmosphere. Such aging further improves the coercive force of the rare-earth magnet. The aging may be constituted by multistage heat treatment steps. In the aging constituted by two stages of heat treatment, for example, the first stage of heat treatment may heat the sintered product for 0.1 to 50 hr at a temperature of at least 700° C. but lower than the sintering temperature. The second stage of heat treatment may heat the sintered product at 450 to 700° C. for 0.1 to 100 hr.

The sintered product (magnet matrix) obtained by the foregoing process comprises, at least, a main phase made of a crystal particle group of an R-T-B-based alloy and an R-rich phase mainly composed of the rare-earth element R. A part of Cu, Co, and Fe also precipitates in the grain-boundary phase.

A magnet matrix having a desirable size is cut out from the sintered product, and elemental Al, an Al alloy, or an Al compound is attached to the surface of the magnet matrix. An example of methods for attaching Al is one uniformly coating the whole surface of the magnet matrix with a coating liquid in which particles made of Al are dispersed. The Al particles to be attached to the surface of the magnet matrix preferably have a particle size of 50 μm or less. When the Al particle size is too large, it may be problematic in that Al is harder to diffuse into the magnet matrix. Al may be attached to the surface of the magnet matrix by techniques such as plating and vapor-phase methods.

The magnet matrix having Al attached to its surface is heat-treated. This thermally diffuses Al from the surface of the magnet matrix to the R-rich phases in the grain-boundary phases of the magnet matrix, while Cu and Co contained in the grain-boundary phases within the magnet matrix migrate to the surface layer as being induced by the diffusion of Al, so as to form an alloy of R, Al, Cu, and Co. The R—Cu—Co—Al alloy has a melting point lower than that of the main phase and thus is segregated at the grain-boundary triple junctions. As a result, the rare-earth magnet of the second embodiment is completed. The magnet matrix having Al attached to the surface is preferably heat-treated at 650° C. or lower, more preferably at 600° C. or lower. This makes it easier to form the R—Cu—Co—Al phase only in the surface part of the rare-earth magnet. When the heat treatment temperature is higher than 650° C., Al whose melting point is about 660° C. may melt and react with the main phase (R—Fe—B-based alloy) of the magnet matrix so as to yield an alloy. When the heat treatment temperature for the magnet matrix having Al attached to the surface is too high, Al may thermally diffuse not only into the R-rich phases at the grain-boundary triple junctions in the surface part but throughout the magnet matrix.

Preferably, the magnet matrix heated by the above-mentioned heat treatment is rapidly cooled at a cooling rate of 30° C./min or higher. This makes it easier to form the R—Cu—Co—Al phase only in the surface part of the rare-earth magnet.

The diffusion length D of Al from the magnet matrix surface, the total of Cu, Co, and Al contents in the R-rich phases at the grain-boundary triple junctions, and the ratio of the main phase to the whole rare-earth magnet can be controlled as appropriate according to the respective contents of Cu, Co, and Al in the material alloy, the amount of Al to be attached to the surface of the magnet matrix, the heat treatment temperature or heat treatment time for the magnet matrix having Al attached to the surface, and the like.

Preferably, the rare-earth magnet is subjected to aging as with the sintered product mentioned above. The aging further improves the coercive force of the rare-earth magnet. Preferably, the aging temperature does not exceed the heating temperature required for thermally diffusing Al. Preferably, the rare-earth magnet heated by the aging is rapidly cooled at a cooling rate of 30° C./min or higher. This makes it easier for the rare-earth magnet to improve its magnetic characteristic.

After heat-treating the magnet matrix having Al attached to the surface, Al and the like remaining on the surface of the rare-earth magnet may be removed by polishing or etching. A protective layer may be formed on the surface of the rare-earth magnet as in the first manufacturing method. Any protective layer can be employed without any restrictions in particular as long as it is typically formed as a layer for protecting the surface of a rare-earth magnet. Examples of the protective layer include resin layers formed by coating or vapor deposition polymerization, metal layers formed by plating or vapor-phase methods, inorganic layers formed by coating or vapor-phase methods, oxide layers, and chemically converted layers.

The second embodiment of the present invention will now be explained in more detail with reference to Examples 21 to 23, which do not restrict the second embodiment of the present invention.

Example 21

By powder metallurgy, an ingot having a composition constituted by 22.5 wt % of Nd, 5.2 wt % of Pr, 2.7 wt % of Dy, 0.5 wt % of Co, 0.3 wt % of Al, 0.07 wt % of Cu, 1.0 wt % of B, and the remainder of Fe was produced. The ingot was roughly pulverized, and the resulting rough powder was pulverized in an inert gas by a jet mill, so as to yield a finer powder having an average particle size of about 3.5 μm. The finer powder was caused to fill a mold and molded under pressure in a magnetic field, whereby a molded product was obtained. The molded product was fired in a vacuum and then subjected to aging, so as to yield a sintered product. The sintered product was cut out, so as to produce a magnet matrix having a size of 10 mm×8 mm×1 mm.

The surface of the magnet matrix was degreased and etched. A coating liquid in which Al particles having an average particle size of 3 μM were dispersed was prepared. The etched surface of the magnet matrix was coated with the coating liquid by dip coating, so as to form a coating film having a thickness of about 8 μm on the whole surface of the magnet matrix. The coating film was dried for 20 min at 120° C.

The magnet matrix having the coating film was heat-treated in an Ar atmosphere at 600° C. for 1 hr and then rapidly cooled at 50° C./min, so as to cause Al in the coating film to diffuse into the magnet matrix. The heated magnet matrix was aged for 1 hr in the Ar atmosphere at 540° C. and then rapidly cooled at 50° C./min. The reactants remaining on the surface of the aged magnet matrix were polished away, and then the surface of the magnet matrix was etched, whereby the rare-earth magnet of Example 21 was obtained.

Example 22

The rare-earth magnet of Example 22 was made by the same method as with Example 21 except that the magnet matrix having the above-mentioned coating film was heat-treated in the Ar atmosphere at 570° C. for 1 hr, so as to cause Al in the coating film to diffuse into the magnet matrix.

Example 23

In Example 23, the magnet matrix having the above-mentioned coating film was heat-treated in the Ar atmosphere at 540° C. for 1 hr, so as to cause Al in the coating film to diffuse into the magnet matrix. Since this single heat treatment also served as aging, no separate aging was carried out after the heat treatment in Example 23 unlike Example 21. Except for these matters, the rare-earth magnet of Example 23 was made by the same method as with Example 21.

Comparative Example 21

The rare-earth magnet of Comparative Example 21 was made by the same method as with Example 21 except that the steps subsequent to the first etching were not carried out. That is, the rare-earth magnet of Comparative Example 21 was made without using Al.

Composition Analysis

Each of the rare-earth magnets of Examples 21 to 23 and Comparative Example 21 was cut, and the element distribution in the polished cut section was seen with EPMA. Employed as an EPMA apparatus was JXA-8800 manufactured by JEOL. In the EPMA, elements existing in a region (hereinafter referred to as "surface part A") having a depth of 0 to 100 μm from the outer surface of the rare-earth magnet and a width of 100 μm in a direction parallel to the outer surface were mapped, so as to specify an R-rich phase, and the circle of a spot having a diameter of 1 μm in this phase was analyzed. The surface part A has an area of 100 μm×100 μm. Table 4 lists the respective contents (at %) of elements in the main phase existing in the surface part A of each rare-earth magnet. Table 4 also lists the respective contents (at %) of elements in the R-rich phases included at the grain-boundary triple junctions existing in the surface part A of each rare-earth magnet. The content of each element in the main phase is the average value of contents of each element measured in three given main-phase particles (crystal particles) within the surface part A. The content of each element in the R-rich phases at the grain-boundary triple junctions is the average value of contents of each element measured in the respective R-rich phases at three given grain-boundary triple junctions within the surface part A. Since the main phases of the rare-earth magnets in these examples have the same composition, Table 4 also lists the main phase composition common to Examples 21 to 23.

Figure 9:
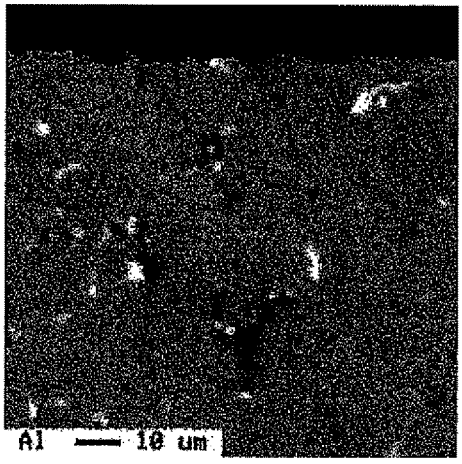
FIG. 9(*a*) is a distribution map of Al in a surface part of the rare-earth magnet of Example 21 produced according to an analysis by an electron probe micro-analyzer (EPMA), FIG. 9(*b*) is a distribution map of Cu in the surface part of the rare-earth magnet of Example 21 produced according to the analysis by the EPMA, and FIG. 9(*c*) is a distribution map of Co in the surface part of the rare-earth magnet of Example 21 produced according to the analysis by the EPMA.
Figure 9:
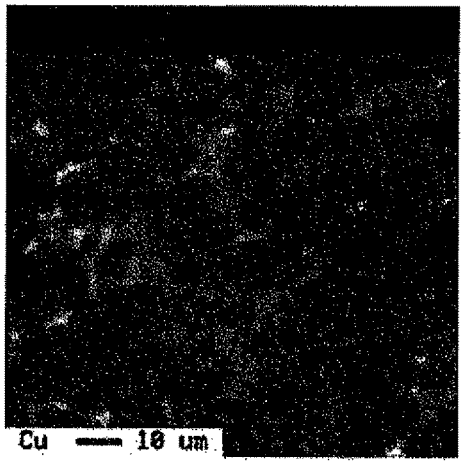
Figure 9:
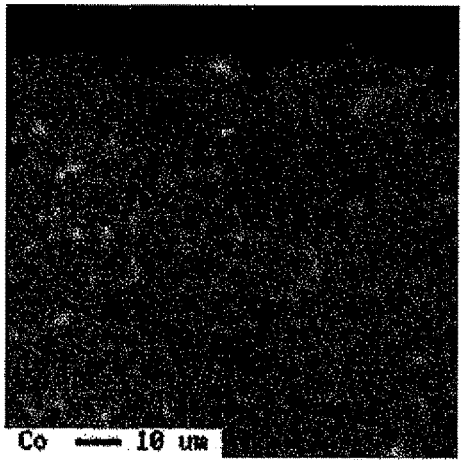

FIG. 9(*a*) illustrates a distribution map of Al in the surface part A of Example 21. White parts in FIG. 9(*a*) are those where Al exists. FIG. 9(*b*) illustrates a distribution map of Cu in the surface part A of Example 21. White parts in FIG. 9(*b*) are those where Cu exists. FIG. 9(*c*) illustrates a distribution map of Co in the surface part A of Example 21. White parts in FIG. 9(*c*) are those where Co exists.

TABLE 4

| | | Unit: at % | | | | | | | |
|---|---|---|---|---|---|---|---|---|---|
| | | Nd | Pr | Dy | Fe | B | Co | Cu | Al |
| Main phase | | 10 | 2 | 3 | 78 | 5 | 0.5 | 0.02 | 0.8 |
| Grain-boundary triple junction | Example 21 | 50 | 21 | 0 | 5 | 0 | 9 | 9 | 6 |
| | Example 22 | 39 | 16 | 0 | 24 | 0 | 5 | 6 | 7 |
| | Example 23 | 30 | 11 | 0 | 46 | 0 | 3 | 2 | 8 |
| | Comparative Example 21 | 69 | 26 | 0 | 4 | 0 | 1 | 0 | 0 |

As a result of the EPMA analysis, the ratio of the main phase constituted by the crystal particles of the R-T-B-based alloy was seen to be 91 vol % of the whole rare-earth magnet in each of the rare-earth magnets of Examples 21 to 23. A large amount of Al was seen to have diffused into the R-rich phases at the grain-boundary triple junctions in the surface part of each of the rare-earth magnets of Examples 21 to 23. It was also seen that Al at each grain-boundary triple junction hardly diffused into the main phase in Examples 21 to 23. Cu and Co were seen to exist in the surface part of each of the rare-earth magnets of Examples 21 to 23 by a greater amount than in Comparative Example 21. As is clear from the comparison among FIGS. 9(*a*), 9(*b*), and 9(*c*), Al, Cu, and Co were seen to exist in the same positions within the surface part A, so that an alloy containing R, Al, Cu, and Co was formed in the R-rich phase at each grain-boundary junction within the surface part A. Nd, Pr, and Fe were seen to exist in each of the R-rich phases at the grain-boundary triple junctions of Examples 21 to 23. On the other hand, no Al was seen to have diffused in the R-rich phases at the grain-boundary junctions within the surface part A in the rare-earth magnet of Comparative Example 21.

Each rare-earth magnet was analyzed by laser ablation inductively coupled plasma mass spectrometry (LA-ICP-MS). In the analysis by LA-ICP-MS, a cross section of the rare-earth magnet was subjected to mapping measurement at a pitch of 20 μm, so as to measure the diffusion length of Al from the magnet surface. As a result of the LA-ICP-MS, it was seen in Example 21 that Al diffused into a region having a depth of 0 to 400 μm from the outer surface of the rare-earth magnet, so that Cu, Co, and Al had higher concentrations in this region. It was seen in Example 22 that Al diffused into a region having a depth of 0 to 200 μm from the outer surface of the rare-earth magnet, so that Cu, Co, and Al had higher concentrations in this region. It was seen in Example 23 that Al diffused into a region having a depth of 0 to 100 μm from the outer surface of the rare-earth magnet, so that Cu, Co, and Al had higher concentrations in this region.

Evaluation of Corrosion Resistance

The corrosion resistance of each of the rare-earth magnets of Examples 21 to 23 and Comparative Example 21 was evaluated by a pressure cooker test (PCT). In the PCT, each rare-earth magnet was placed under an environment with a pressure of 2 atm, a temperature of 120° C., and a humidity of 100% RH for 300 hr, and thereafter the amount of weight loss was measured. Table 5 lists the amount of weight loss per unit surface area (unit: mg/cm$^2$) of each rare-earth magnet.

TABLE 5

| Table 5 | After 300 hr (unit: mg/cm$^2$) |
|---|---|
| Example 21 | 0 |
| Example 22 | 0.10 |
| Example 23 | 0.17 |
| Comparative Example 21 | 1.43 |

Each of the rare-earth magnets of Examples 21 to 23 was seen to be superior to that of Comparative Example 21 in terms of corrosion resistance.

Each of the rare-earth magnets of Example 21 and Comparative Example 21 was left in a hydrogen atmosphere under a pressure of 0.1 MPa at 100° C. In Comparative Example 21, after the lapse of 100 sec, the rare-earth magnet occluded hydrogen, whereby the hydrogen partial pressure began to drop. In Example 21, on the other hand, the rare-earth magnet did not occlude hydrogen even after the lapse of 300 sec, so that the hydrogen partial pressure did not drop.

Evaluation of Magnetic Characteristic

The residual magnetic flux density (Br) and coercive force (HcJ) of each of the rare-earth magnets of Examples 21 to 23 and Comparative Example 21 were measured. Table 6 lists Br (unit: T) and HcJ (unit: kA/m) of each rare-earth magnet.

TABLE 6

| Table 6 | Br (Unit: T) | HcJ (Unit: kA/m) |
|---|---|---|
| Example 21 | 1.36 | 1424 |
| Example 22 | 1.36 | 1432 |
| Example 23 | 1.36 | 1407 |
| Comparative Example 21 | 1.36 | 1391 |

Each of the rare-earth magnets of Examples 21 to 23 was seen to have a coercive force superior to that of Comparative Example 21.

REFERENCE SIGNS LIST

4 . . . crystal particle; 6 . . . grain-boundary triple junction; 20 . . . center part; 30 . . . stator; 32 . . . coil; 40 . . . high concentration layer or surface part; 50 . . . rotor; 52 . . . core; 100 . . . rare-earth magnet; 200 . . . rotator; D . . . thickness of the high concentration layer or surface part (diffusion length of Al)

What is claimed is:

1. An R—Fe—B-based rare-earth magnet comprising a crystal particle group containing a rare-earth element R, the magnet comprising:

a center part; and a surface part surrounding the center part and including crystal particles of the crystal particle group, an alloy containing R, Cu, Co, Al, and Fe being present in an R-rich phase included at a grain-boundary triple junction of the crystal particles, wherein:

the rare-earth magnet contains Ni;

the total of Cu, Co, and Al contents in the R-rich phase is at least 13 at %;

the alloy containing R, Cu, Co, Al, and Fe is present only in the surface part of the rare-earth magnet and is present only in a region of the magnet whose depth is 400 μm or less from an outer surface of the magnet;

in a direction perpendicular to the outer surface of the magnet, a thickness of the center part is greater than a thickness of the surface part;

the thickness of the surface part in the perpendicular direction is at least 100 μm and 400 μm or less;

a gradient of a concentration distribution based on unit weight of the rare-earth magnet of the Cu is 0.01 to 5 wt %/mm, a gradient of a concentration distribution based on unit weight of the rare-earth magnet of the Co is 0.01 to 5 wt %/mm, a gradient a concentration distribution based on unit weight of the rare-earth magnet of the Al is 0.01 to 5 wt %/mm, and a gradient of a concentration distribution based on unit weight of the rare-earth magnet of the Ni is 0.001 to 0.1 wt %/mm;

each of the gradients is in the direction perpendicular to the outer surface of the rare-earth magnet and directed from the outer surface to an inside of the magnet such that concentrations of the Cu, Co, Al, and Ni are highest at the outer surface; and each value of the gradients is an average concentration gradient from a position where a depth from the outer surface of the rare-earth magnet is 20 μm to a position at ¼ of a thickness of the rare-earth magnet.

2. The rare-earth magnet according to claim 1, wherein the total of Cu and Al contents in the crystal particles is 2 at % or less.

3. A rotator comprising the rare-earth magnet according to claim 2.

4. The rare-earth magnet according to claim 1, wherein the crystal particle group occupies at least 85 vol % of the whole rare-earth magnet.

5. A rotator comprising the rare-earth magnet according to claim 4.

6. A rotator comprising the rare-earth magnet according to claim 1.

7. The rare-earth magnet according to claim 1, wherein the thickness of the surface part in the perpendicular direction is at least 200 μm and less than 400 μm.

8. The rare-earth magnet according to claim 1, wherein an average value of content of Al in the R-rich phase at the grain boundary triple junction within the surface part is 6 to 8 at %.

* * * * *